US006764139B1

(12) United States Patent
Wortman

(10) Patent No.: US 6,764,139 B1
(45) Date of Patent: Jul. 20, 2004

(54) SYSTEM FOR AND METHOD OF DEMOLITION

(76) Inventor: Robert F. Wortman, 7715 Irvington Rd., Omaha, NE (US) 68122

( * ) Notice: Subject to any disclaimer, the term of this patent is extended or adjusted under 35 U.S.C. 154(b) by 0 days.

(21) Appl. No.: 10/045,422

(22) Filed: Jan. 12, 2002

Related U.S. Application Data

(60) Provisional application No. 60/261,887, filed on Jan. 1, 2001.

(51) Int. Cl.[7] ..... B28D 1/26

(52) U.S. Cl. ..... 299/10; 299/24; 299/39.3; 299/100; 299/95; 37/403; 172/817

(58) Field of Search ..... 172/617, 247; 37/403, 404; 414/724; 299/37.3, 37.4, 37.5, 24, 10, 100, 79.1, 95

(56) References Cited

U.S. PATENT DOCUMENTS

| | | | | | |
|---|---|---|---|---|---|
| 48,849 | A | * | 7/1865 | Spink | 172/771 |
| 2,969,966 | A | * | 1/1961 | Matheis | 299/26 |
| 3,403,940 | A | * | 10/1968 | Clark | 299/26 |
| 3,596,996 | A | * | 8/1971 | Carter | 299/10 |
| 3,658,384 | A | * | 4/1972 | Gluszek | 299/37.3 |
| 3,807,802 | A | * | 4/1974 | Betters | 299/37.3 |
| 4,004,539 | A | * | 1/1977 | Wesson | 114/221 R |
| 4,327,509 | A | * | 5/1982 | Bean | 37/404 |
| 5,394,629 | A | * | 3/1995 | Ruvang et al. | 37/457 |
| 5,689,905 | A | * | 11/1997 | Ibusuki | 37/403 |
| 6,311,417 | B1 | * | 11/2001 | Pratt | 37/404 |
| 6,517,164 | B1 | * | 2/2003 | White | 299/37.5 |

* cited by examiner

*Primary Examiner*—John Kreck
(74) *Attorney, Agent, or Firm*—Dorothy S. Morse

(57) ABSTRACT

A rugged demolition system, and method for its use, for pulling up horizontal structures such as concrete or asphalt and breaking them into pieces, pulling over and breaking up vertical structures such as retaining walls and house/building walls, pulling up vertically extending objects from the ground such as tree roots, and breaking up hard or compacted surfaces such as dirt for easier grading. The system has a spear mounted horizontally to the top of a downwardly curving pry hook assembly, a digging tooth and optional side hooks connected to the pry hook assembly, and the pry hook assembly optionally secured to a tubular support member depending perpendicularly from a plate. Although any position-controlling vehicle can be employed to cause the needed vertical, horizontal, and rotational movement of the plate during system use, the plate is configured for attachment to the standard mount of a skid steer loader.

20 Claims, 8 Drawing Sheets

SYSTEM FOR AND METHOD OF DEMOLITION

CROSS-REFERENCES TO RELATED APPLICATIONS

This application is a continuation of U.S. Provisional Patent Application, Serial No. 60/261,887, filed on Jan. 1, 2001 by the same inventor for substantially the same subject matter.

BACKGROUND OF THE INVENTION

1. Field of the Invention

The present invention relates to systems and methods of demolition, more particularly to a system and method of utilizing a rugged demolition attachment with a position-controlling motor vehicle, such as a skid steer loader, that can raise, lower, and provide horizontal movement for the attachment, as well as rotate the attachment according to need, whereby the sturdy pry hook assembly on the attachment in combination with its sturdy spear and one or more optional side hooks positioned between the pry hook and the spear can pull up horizontal structures such as concrete or asphalt and break it into pieces; pull over and break up vertical structures such as retaining walls and house/building walls; extract vertically extending objects such as tree roots out of the ground; and break up hard surfaces such as compacted dirt for easier grading. The pry hook assembly can be connected to the mount of the position-controlling motor vehicle, or via a tubular support structure perpendicularly depending from the front side of a plate welded to the mount. Also, it is contemplated for some embodiments of the present invention to have removable components for easy inspection, repair, and/or replacement.

2. Description of the Related Art

Many methods of demolition are known for horizontal and vertical structures. Jack hammers are commonly used to crack horizontal structures such as concrete or asphalt and the like. Buckets attached to the front of skid steer loaders are often used thereafter to pry-up the broken pieces of concrete and asphalt, etc., and move them to a remote location or to a vehicle for transport offsite. A major disadvantage of the aforementioned method of demolition for horizontal structures is that it requires the sequential use of two separate systems, a jack hammer and a skid steer loader bucket. Further, employing the skid steer loader bucket for prying use dramatically increases its risk for breakage. In contrast, the spear and pry hook assembly of the present invention, when connected to a position-controlling vehicle such as a skid steer loader, performs all of the cracking, prying, and moving functions needed for demolition of a horizontal structure and can also be used to break up hard surfaces, such as compacted dirt prior to grading. The present invention system saves time on a demolition job since it has a rugged design and construction, is made from durable materials to minimize down time attributable to breakage and/or installation of replacement parts, and is efficient to use since the prying, cracking, and moving functions can follow one another in quick succession and be repeated in any order, without the need to employ any additional pieces of equipment, such as a jack hammer.

There is also a need for demolition of vertically oriented structures such as retaining or house/building walls. However, it is often difficult to get sufficient access thereto using conventional demolition systems. Therefore, particularly in tight areas, it would be advantageous to have a system of demolition that could, in any appropriate order, break, pry-up, and move demolished parts of horizontally oriented structures, such as concrete or asphalt and the like slabs, (including hard dirt), as well as easily access vertically oriented structures such as retaining and houses/building etc. walls to pull them over and/or break them up, or extract vertically extending objects such as tree roots etc. from the ground. The present invention provides a system and method of demolition for both horizontal and vertically oriented surfaces which overcomes the disadvantages frequently experienced in many of the commonly used prior art methods and systems of demolition.

The invention thought to be the closest to the present invention is the excavator bucket assembly disclosed in U.S. Pat. No. 6,311,417 to Pratt (2001). The Pratt invention uses a bucket with at least one ripper tooth connected to the outside surface of the bucket, each ripper tooth being movable between stored and extended positions. A blade member can also interconnect a pair of ripper teeth attached to the bucket. Thus, when the Pratt bucket is rotated, the ripper tooth or teeth engage the ground for excavation purposes, after which the bucket can be used to move the excavated portions of the ground. The Pratt invention teaches its bucket assembly only being used to scoop comparatively loose soils, with the ripper tooth modification one its bucket assembly being used to loosen hard, compacted, and rocky soil. The Pratt invention does not teach its ripper or digging teeth being sufficiently sturdy for routine demolition work without breakage, or either types of teeth being used to break up anything other than rock and soil. In contrast, the present invention is a rugged demolition attachment configured for removable connection to the mount on a position-controlling motor vehicle, such as a skid steer loader, which raises, lowers, provides horizontal movement for, and rotates the attachment promptly and into the positions needed for effective demolition use. The present invention uses a pry hook assembly and a spear-like prying device, along with optional side hooks, to alternatively snag, pry up, pull over, break, crack, and move portions of horizontal and vertically oriented structures during demolition thereof, as well as break up hard surfaces such as compacted dirt and extract vertically extending objects such as tree roots from the ground. The structure of the present invention and the Pratt inventions are different, with the Pratt invention comprising a bucket with a plurality of digging teeth and a pair of ripping teeth that extend from the bucket in a direction nearly opposite that of the digging teeth, whereas the present invention demolition attachment has its spear and pry hook extending in different directions that are closer to 90° apart, rather than the nearly 180° apart that is observed in Pratt. The difference in orientation of the present invention digging and ripping components allows faster demolition than could be achieved by the Pratt invention. Although not critical, for added strength during demolition use, the pry hook assembly can be connected to its plate via a tubular support member, whereby the proximal end of the pry hook assembly is inserted within the distal end of the tubular support member and not simply attached to its outer surface. If the digging tooth, side hooks, and spear-like prying device of the present invention were connected to an excavating bucket, the Pratt invention would be validly cited as prior art. However, employment of buckets for demolition use places the buckets at an increased risk for breakage. In the alternative, the present invention provides a demolition attachment for a skid steer loader or other position-controlling vehicle that comprises a rugged plate and pry hook assembly that includes a spear-like prying device, side hooks, and a digging tooth. There is no known system and method with the same rugged features and sturdy design, or one that can provide all of the advantages of the present invention for demolition and other purposes.

BRIEF SUMMARY OF THE INVENTION

Objectives and Advantages

It is the primary object of the present invention to provide a demolition attachment for a position-controlling motor vehicle, such as a skid steer loader, that can alternatively snag, pry up, pull over, break, crack, and move portions of horizontal and vertically oriented structures during demolition use. It is also an object of the present invention to provide a demolition attachment for a position-controlling motor vehicle, such as a skid steer loader, that in addition to demolition use can also be used for construction site clearing and leveling use, such as the break up of compacted dirt prior to grading and the extraction vertically extending objects such as tree roots from the ground. It is a further object of the present invention to provide a demolition attachment for a position-controlling motor vehicle, such as a skid steer loader, that is rugged and durable, efficient to use, and allows for easy parts replacement when needed. Other purposes and/or objectives of the present invention will become apparent upon a reading of the specification and claims.

The present invention provides a system and method for general purpose demolition that includes the cracking, breaking up, pulling over, prying up, and moving of both horizontal and vertically oriented structures/surfaces. A first embodiment of the present invention system comprises a plate designed to mate with a standard universal skid steer loader mount. The plate has a support member affixed thereto in perpendicular association, which is preferably tubular in configuration to reduce its weight. A pry hook assembly, comprising a spear and pry hook tip (digging tooth), is attached to the distal end of the support member. The spear is preferably attached via a sleeve to the top of the pry hook assembly. When said spear and pry hook assembly are viewed from one side in elevation, the spear is shown projecting in a substantially horizontal position to the right and extending beyond the pry hook assembly, while the pry hook and pry hook tip curve downwardly and to the left with a near 90° divergence in orientation from the spear. The first preferred embodiment of the present invention provides that the spear and pry hook tip be solidly attached to said pry hook assembly; however, in other embodiments the spear, pry hook tip, or both may be removably attached to the pry hook assembly. Removable mounting of the spear, pry hook tip, and digging tooth allows for easy adjustment and/or removal of the spear and pry hook tip for inspection, repair, and/or replacement. Further, although not limited thereto, a jack hammer bit may be employed as the spear in various embodiments of the present invention and a bucket tooth or rugged component similarly configured to a bucket tooth may be employed as the pry hook tip or digging tooth.

Several methods of use are contemplated for the preferred embodiments of the present invention. Three such methods are provided by way of example only, and are not considered to be limiting. A method of demolishing horizontally extending structures such as concrete or asphalt and the like, and which makes use of the disclosed invention, comprises the steps of:

a. providing a region of concrete or asphalt or the like targeted for demolition;

b. in combination with step a. providing a demolition system as described above;

c. via said attachment means affixing said demolition system, affixing said demolition system to a vehicle for causing said demolition system to assume orientations between substantially vertical and substantially horizontal, and to cause said demolition system to move, up and down, and/or back and forth;

d. optionally orienting said tool above said concrete or asphalt or the like so that said spear projects substantially downward and causing said vehicle to cause said spear to repeatedly pound on said concrete or asphalt or the like to the end that said concrete or asphalt or the like is cracked;

e. orienting said demolition system above said concrete or asphalt or the like so that said spear projects other than substantially vertically and said pry hook projects generally downward and back toward said attachment means, and causing said vehicle to cause said pry hook to be positioned such that it snags an edge or created crack in said concrete or asphalt or the like and then moves horizontally so as to pry said cracked concreter or asphalt or the like away from remaining areas of said concrete or asphalt or the like; and f. optionally utilizing said spear to move demolished pieces concrete or asphalt or the like.

Another method of demolishing horizontally extending surfaces such as concrete or asphalt and the like, and which makes use of the disclosed invention, comprises the steps of:

a. providing a region of concrete or asphalt or the like to be demolished;

b. in combination with step a. providing a demolition system as described above;

c. via said attachment means affixing said demolition system, affixing said demolition system to a vehicle for causing said demolition system to assume orientations between substantially vertical and substantially horizontal, and to cause said demolition system to move, up and down, and/or back and forth;

d. orienting said tool above said concrete or asphalt or the like so that said spear projects other than substantially vertically and said pry hook projects generally downward and back said pry hook to be positioned such that it snags an edge of said concrete or asphalt or the like and then moves horizontally so as to pry said concrete or asphalt or the like away from remaining areas of said concrete or asphalt or the like;

f. optionally utilizing said spear to move demolished pieces concrete or asphalt or the like.

It is noted that the terminology "or the like" when added to the words "concrete or asphalt" is intended to include compacted dirt and other hard surfaces.

A method of using the disclosed invention for demolition of vertically extending structures comprises the steps of:

a. providing a vertical structure such as a retaining wall or house wall above a surface, or tree roots below below surface;

b. in combination with step a. providing a demolition system as described above;

b. orienting said demolition system described so that said spear projects other than substantially vertically and said pry hook projects generally downward and back toward said attachment means, and causing said vehicle to cause said pry hook to be positioned such that it snags said vertical structure and then moves horizontally so as to cause said vertical structure to be demolished; and c. optionally utilizing said spear to move portions of the demolished vertical structure.

It is noted that demolition of a tree root is described as the cutting thereof and/or pulling it is vertically out of the ground. Also, one example of a preferred skid steer loader intended for use with the present invention, is the product marketed under the registered trademark of BOBCAT.

While the description herein provides preferred embodiments of the present invention demolition attachment, it should not be used to limit its scope. For example, variations of the present invention, while not shown and described herein, can also be considered within the scope of the present invention, such as variations in the size of the plate connected to the skid steer loader mount; the length of the spear used; the location and number of side hooks, when used; the thickness and type of material used for the plate and tubular support member; the material from which the plate, tubular support member, and pry hook assembly are made; and the configuration of the digging tooth. Thus, the scope of the present invention should be determined by the appended claims and their legal equivalents, rather than being limited to the examples given.

DETAILED DESCRIPTION OF THE INVENTION

Figure 1A:
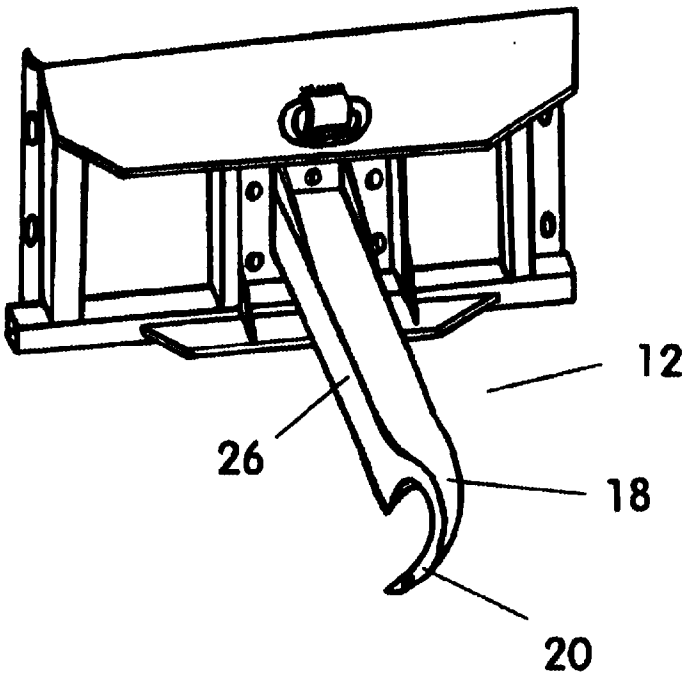
FIG. 1*a* is a perspective view of the most preferred embodiment of the present invention demolition attachment having a pry hook assembly (12) comprising a tubular support member (26) in functional combination with a digging tooth (20).
Figure 1B:
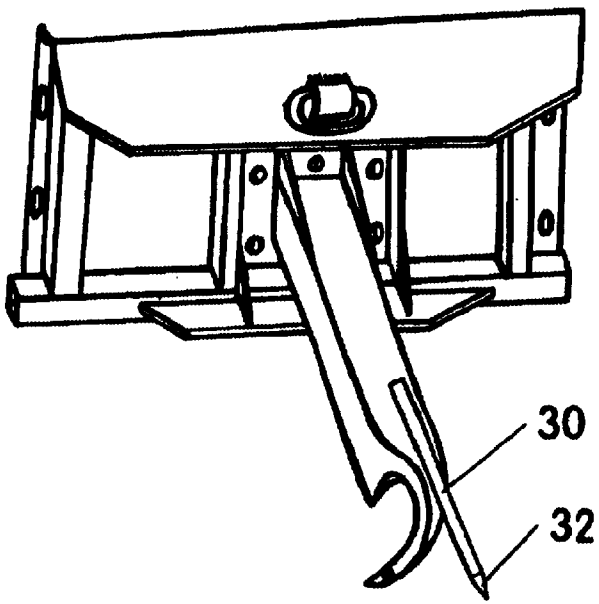
FIG. 1*b* is a perspective view of the most preferred embodiment of the present invention demolition attachment having a spear (30) and spear tip (32).
Figure 2A:
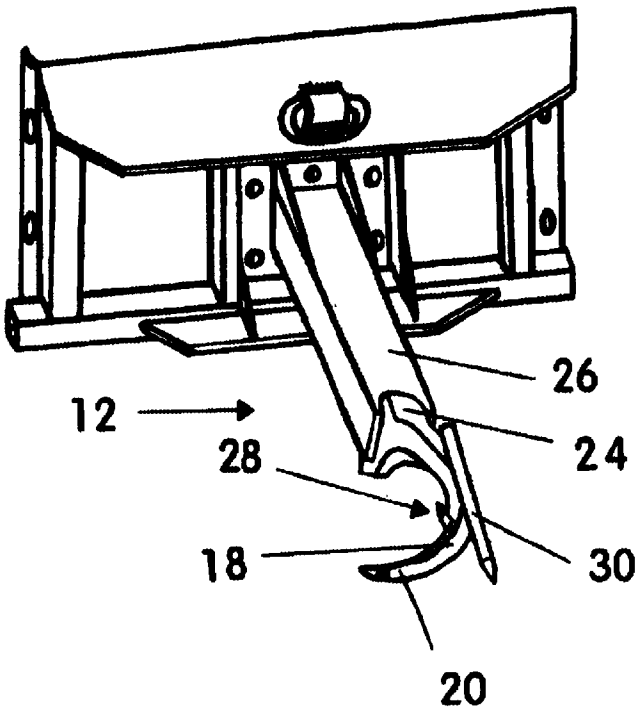
FIG. 2*a* is a perspective view of the most preferred embodiment of the present invention demolition attachment having a spear (30) attached to the upper portion of pry hook assembly (12) and extending beyond digging tooth (20).
Figure 2B:
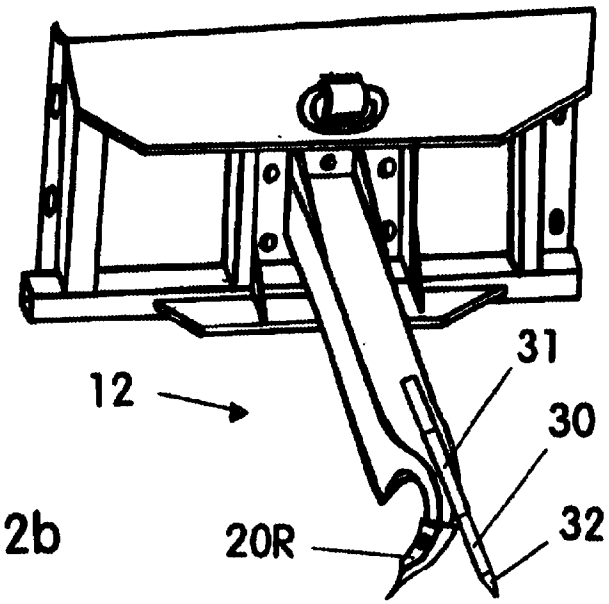
FIG. 2*b* is a perspective view of the most preferred embodiment of the present invention demolition attachment having a variation of the spear (30) and pry hook assembly (12) shown in FIG. 2*a*, with spear (30) and digging tooth (20R) being removable components of pry hook assembly (12).
Figure 3B:
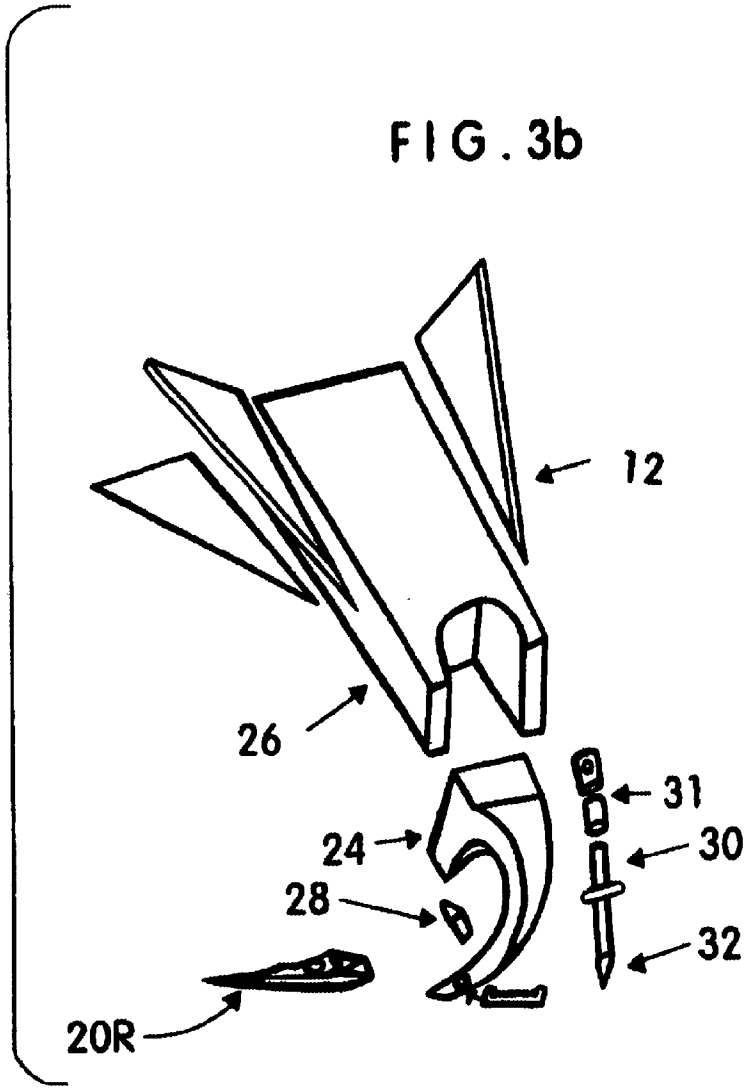
FIG. 3*b* is an exploded view of the pry hook assembly in the most preferred embodiment of the present invention demolition attachment with sleeve (31), spear (30), side hook (28), and digging tooth (20R) being removable components of pry hook assembly (12).
Figure 3A:
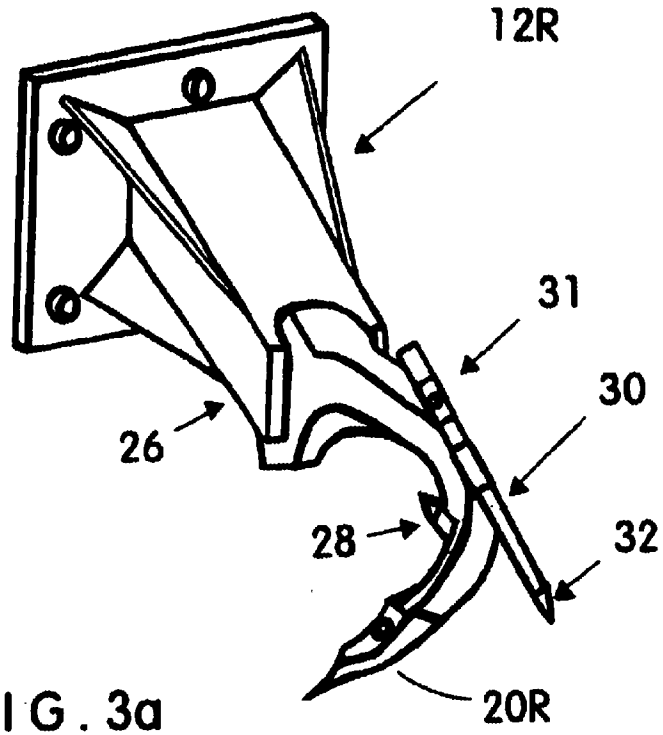
FIG. 3*a* is a perspective view of the pry hook assembly (12) in the most preferred embodiment of the present invention demolition attachment wherein spear (30) is removably connected to pry hook assembly (12) by a sleeve 31 and digging tooth (20R) is also easily removed from its usable position.

FIG. 1*a* shows one embodiment of the demolition attachment of the present invention having a pry hook assembly (12) comprising an extension tube (26) in functional combination with a pry hook (18) which comprises a pry hook tip (20). FIG. 1*b* shows pry hook assembly (12) having a spear (30) with spear point (32). FIG. 2*a* shows a combined spear (30) and pry hook assembly (12) which comprises an extension tube (26) and a pry hook (18), to which is affixed a side hook (28). Note that the base of the pry hook (24) is configured for positioning within the distal end of extension tube (26) to provide a more rugged connection when it is welded to the extension tube (26). Note also that a spear (30) is welded to the top (22) of the pry hook (18). FIG. 2*b* shows a variation of the system shown in FIG. 2*a*. Note in particular that the spear (30) is removably affixed to the top the of the pry hook assembly (12) via securing means (31), and that a removable pry hook (20R) is detachably mounted at the location of the pry hook tip (20) in FIG. 1*a*. The removable spear (30) and removable pry hook (20R) comprise a preferred arrangement. FIGS. 3*a* and 3*b* show additional embodiments of the present invention pry hook assembly (12) using the same identifiers employed in FIGS. 2*a* and 2*b*. FIG. 3*b* is an exploded view of the assembled invention shown in FIG. 3*a*. Although not critical, the removable spear (30) can be a jack hammer spear or other component substantially like a jack hammer spear, and a preferred detachable digging tooth (20R) can be a detachable skid steer loader bucket tooth or other component substantially like a skid steer loader bucket tooth, for prompt, easy, and economical replacement since each item is commonly available in the marketplace.

Figure 10:
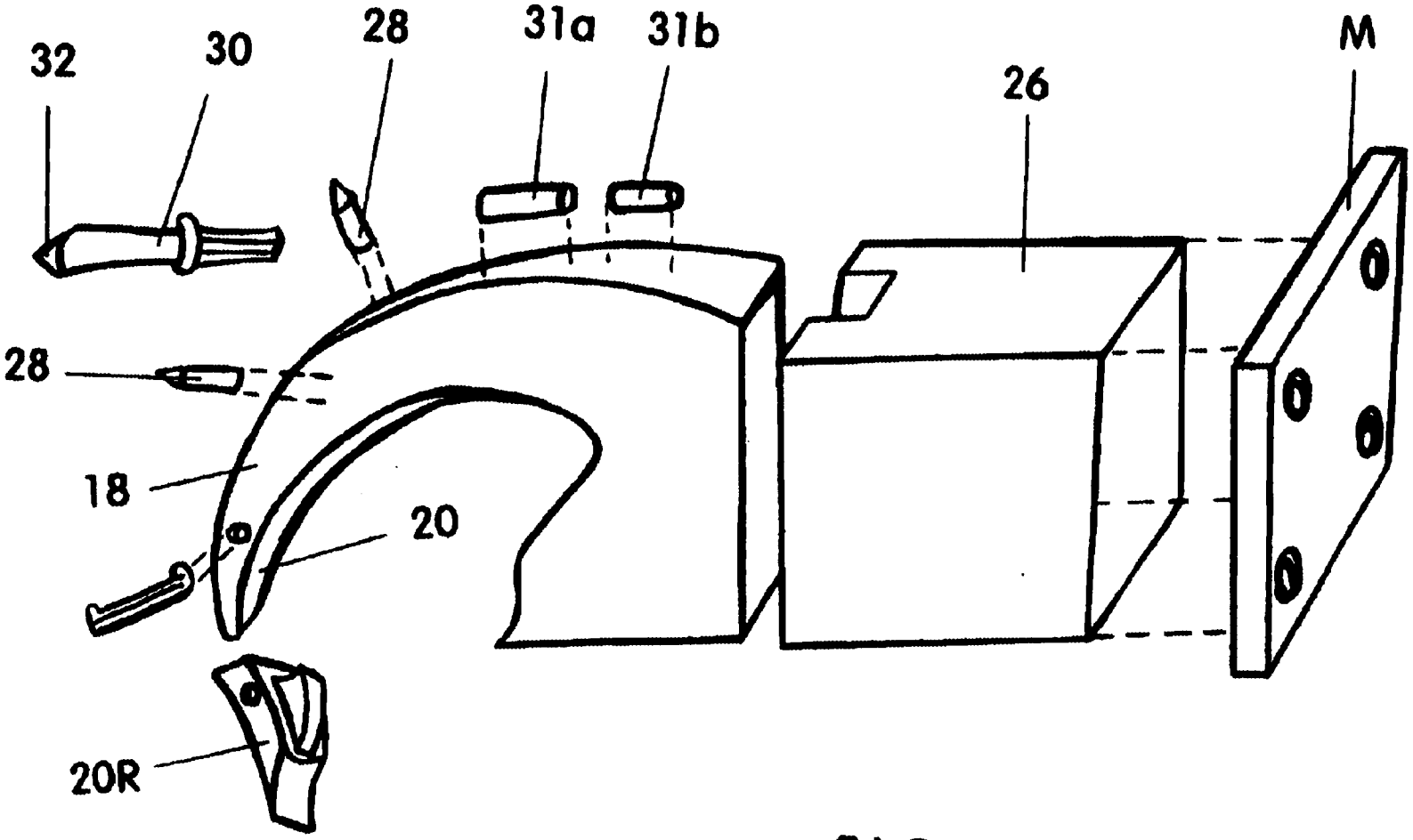
FIG. 10 is an exploded view of the components of a pry hook assembly (12) of the present invention demolition attachment, including a removably mountable spear (30) and removably mountable digging tooth (20R).

FIG. 10 shows an exploded view of a pry hook assembly (12) which has elements similar to those illustrated in FIGS. 2*a*, 2*b*, 3*a*, and 3*b*. Shown in FIG. 10 are an attachment means (13), an extension tube (26), a pry hook (18) including the pry hook tip (20) and a side hook (28). Note that two securing means (31*a*) and (31*b*) are present into which spear (30) is secured in use. Note also removable pry hook (20R) is present separate from the pry hook tip (20), to which it is secured in use. To give some idea of a representative size for the present invention demolition attachment, note that dimension: "X" is about 9 inches; "Y" is about 14.5 inches; "W" is about 3 inches; "Z" is about 2 inches; "Z" is about 2 inches; "Z" is about 2 inches; "A" is about 6 inches; and "B" is about 4 inches. (Note that said dimensions are demonstrative and not limiting).

Figure 5:
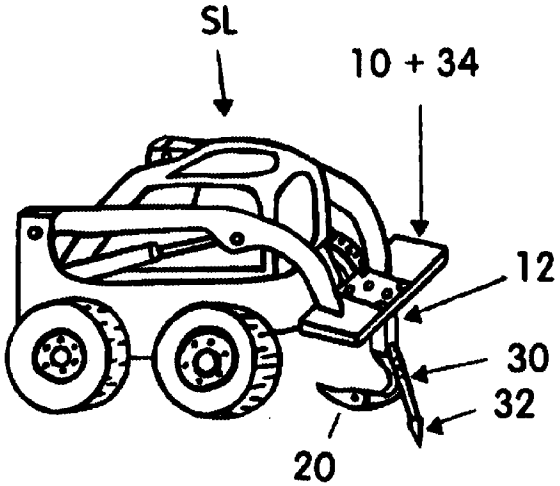
FIG. 5 is a perspective view of the pry hook assembly (12) in the most preferred embodiment of the present invention demolition attachment connected to a skid steer loader (SL) with spear (30) oriented in a vertically extending position for up and down movement that could be useful in cracking concrete or asphalt, or in breaking up compacted soil.
Figure 4:
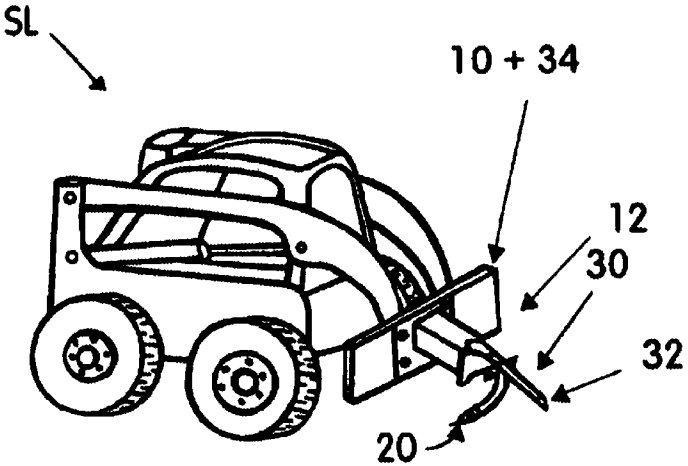
FIG. 4 is a perspective view of the pry hook assembly (12) in the most preferred embodiment of the present invention demolition attachment connected to a skid steer loader (SL) with spear (30) oriented in a horizontally extending position for forward and backward movement that could be useful in toppling vertical structures such as a wall.
Figure 8A:
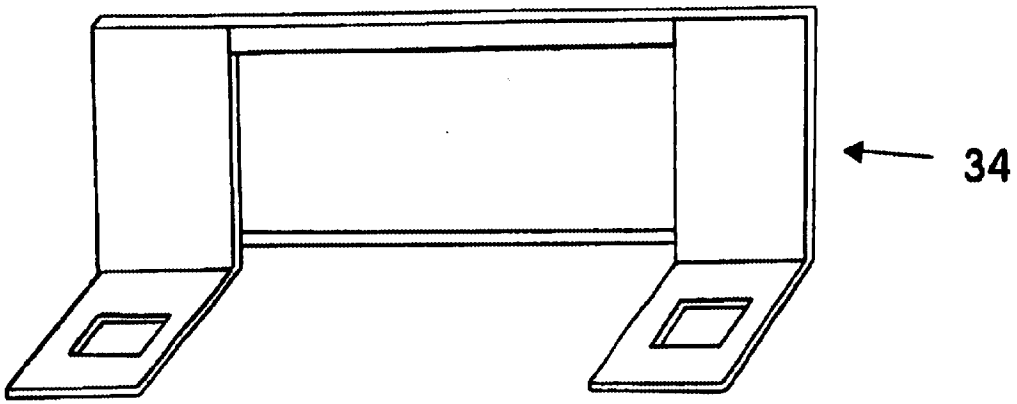
FIG. 8*a* is a front view of the standard mount (34) of a skid steer loader (SL).
Figure 8B:
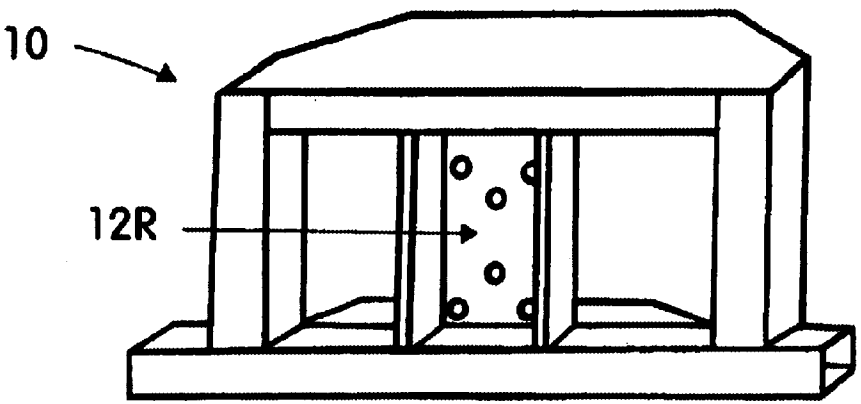
FIG. 8*b* is a front view of the plate (10) which is easily welded to the standard mount (34) shown in FIG. 8*a*.
Figure 9:
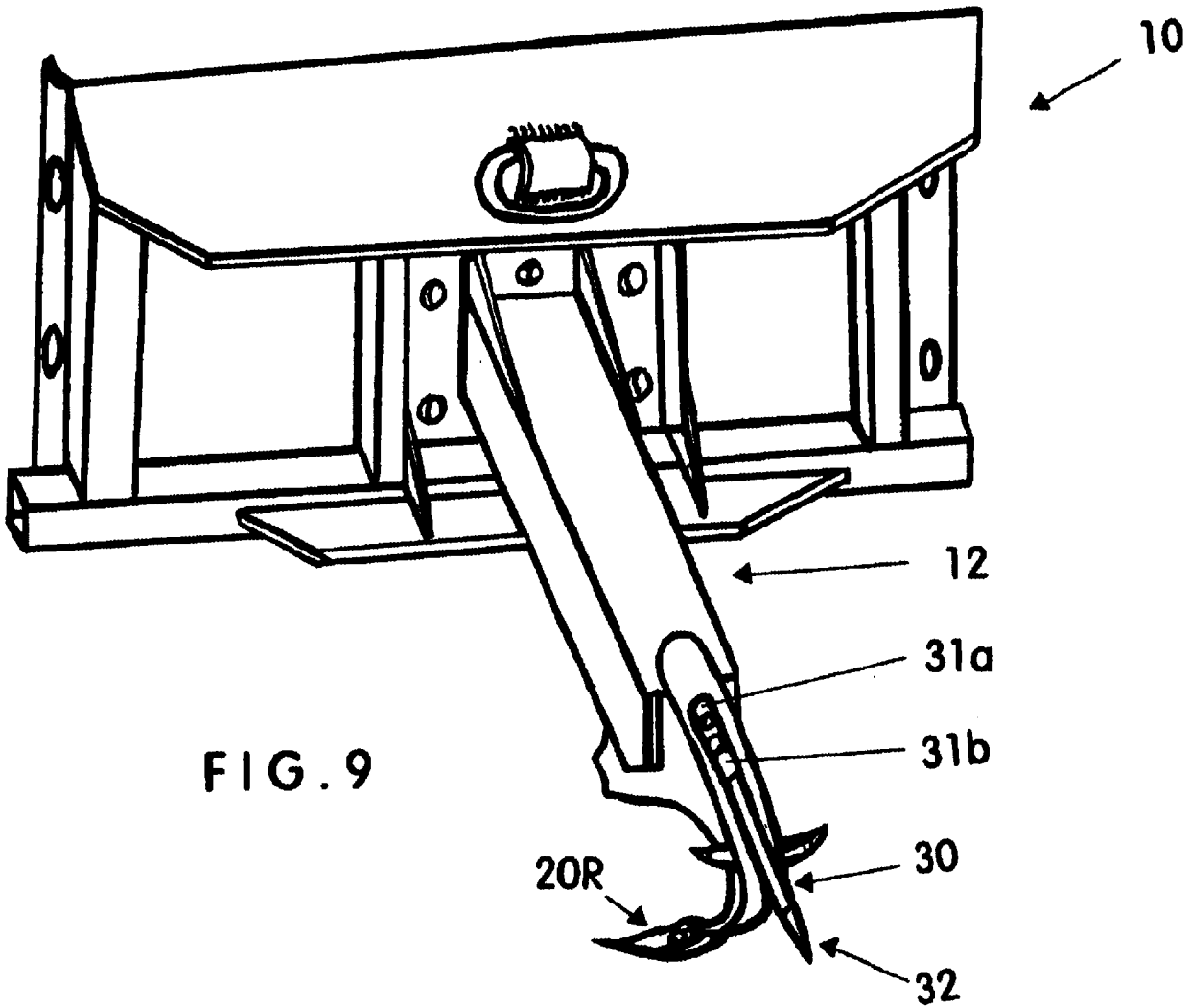
FIG. 9 is a perspective view of the most preferred embodiment of the present invention plate (10) with a pry hook assembly (12) and spear (30) mounted thereto.

FIGS. 4 and 5 shows a skid steer loader (SL) with a pry hook assembly (12) as shown in FIGS. 2*a*, 2*b*, 3*a*, and 3*b* functionally affixed thereto. FIG. 8*a* shows skid steer loader universal mount (34) which is affixed to a skid steer loader (SL) as shown in FIGS. 4 and 5, and FIG. 8*b* shows a plate (10) which fits to the skid steer loader universal mount (34). FIG. 9 shows a pry hook assembly (12) functionally mounted to a FIG. 8*b* plate (10). FIG. 8*b* also shows the back of pry hook assembly (12R) where it attaches to the plate (10). For instance, an attachment means (13) as in FIG. 10 can mount to the front, (ie. the other side of paper as viewed), of the region labeled (12R) in FIG. 8*b*.

Figure 7:
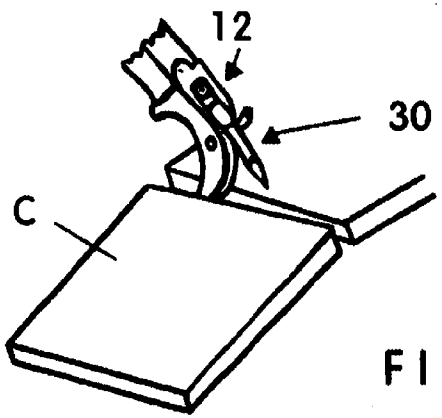
FIG. 7 is a perspective view of the most preferred embodiment of the present invention demolition attachment with spear (30) in a horizontal orientation that allows digging tooth (20) to snag cracked concrete (C).
Figure 6:
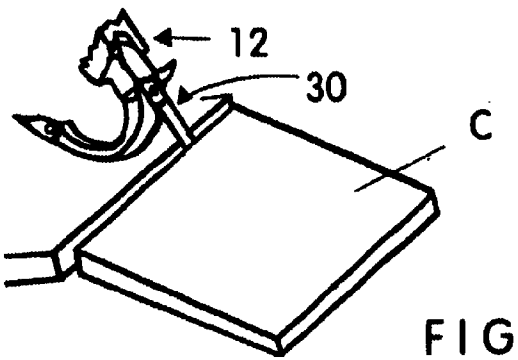
FIG. 6 is a perspective view of the most preferred embodiment of the present invention demolition attachment being attached to a skid steer loader (SL) and shows use of a spear (30) in a vertical orientation for cracking a horizontally extending concrete surface (C).
Figure 11:
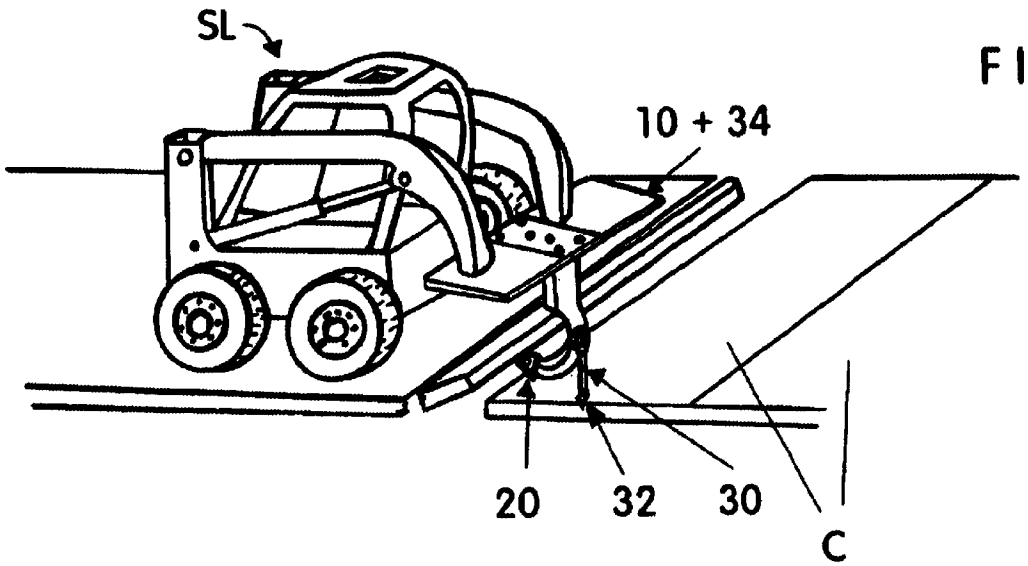
FIG. 11 is a perspective view of a skid steer loader (SL) with a pry hook assembly (12) attached thereto, and in the process of moving a piece of concrete or asphalt or the like (C) with the spear (30) and spear tip (32) thereof.
Figure 12:
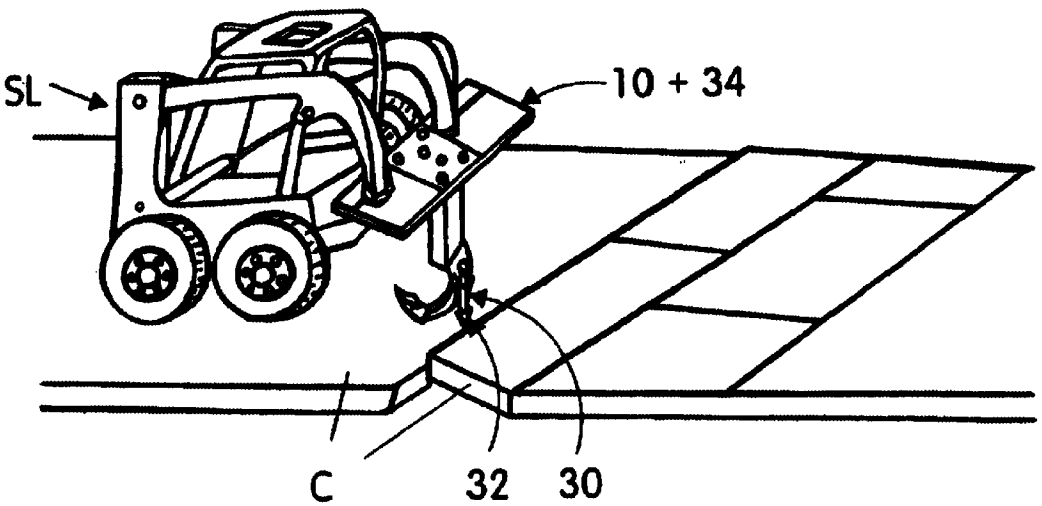
FIG. 12 is a perspective view of a skid steer loader (SL) snagging the edge of a slab of concrete or asphalt or the like (C) with the digging tooth (20) of the most preferred embodiment of the present invention demolition attachment.

In view of FIGS. 8*a*, 8*b*, and 9 it should be appreciated how FIGS. 4 and 5 can be functionally achieved. Further, note also that FIG. 5 shows the spear (30) oriented with its tip (32) pointing downward. FIG. 6 shows how using the skid steer loader (SL) to move said pry hook assembly (12) up and down which can be optionally practiced to cause concrete (C) to be cracked under pressure exerted thereupon by the tip (32) of the spear (30) of the pry hook assembly (12), and FIG. 7 shows how once cracked, the pry hook (20), oriented much as shown in FIG. 4, can snag and then pull the cracked concrete horizontally. It is to be understood that the spear (30) can also be used to move demolished pieces horizontally, and actually is often preferred over the pry hook (18) for that purpose. It is noted that where an edge of a horizontally oriented structure, (eg. concrete slabs), can be snagged without practicing a FIG. 6 indicated cracking operation, the action indicated by FIG. 6 can be skipped. Further, it must be understood that when the spear (30) is used to move pieces of a demolished structure, it need not be oriented substantially vertically as shown in FIG. 6. In fact angular orientation often allows the spear (30) access into areas that would be otherwise inaccessible. FIG. 11 shows a skid steer loader (SL) with a pry hook assembly (12) attached thereto, in the process of moving a piece of concrete or asphalt or the like (C) with the spear (30) thereof. FIG. 12 shows a skid steer loader (SL) snagging a slab of concrete or asphalt or the like (C) with the pry hook (20) thereof to crack the concrete or asphalt or the like (C). As noted, this is a more typical approach than that shown in FIG. 6, which, again, depicts using the spear (30).

As mentioned in the disclosure section of this specification, the disclosed invention can also be employed to demolish vertical structures such as retaining and house/building walls, and the pry hook tips (20) and (20R) can even be used to cut tree roots. Again, demolished pieces of a structure can be moved with the spear (30) and/or the pry hook (18) oriented appropriately to gain leveraged access thereto.

The system of the disclosed invention which comprises the pry hook (18) and spear (30) in a pry hook assembly (12) then is a general purpose demolition tool which when combined with a motion causing vehicle can be used to demolish essentially any horizontally or vertically oriented structure by appropriate alternating use of the spear (30) and pry hook (18).

Having hereby disclosed the subject matter of the present invention, it should be obvious that many modification, substitutions, and variations of the present invention are possible in view of the teachings. It is therefore to be understood that the invention may be practiced other than as specifically described, and should be limited in its breadth and scope only by the claims.

I claim:

1. A demolition attachment for use with a motor vehicle having a standard universal skid steer loader type of mount configured for vertical, horizontal, and rotational movement, said attachment comprising:

a plate designed to mate with said standard universal skid steer loader mount; and said plate having a front surface and affixed thereto a pry hook assembly comprising a spear and pry hook, said spear, as viewed in side elevation, being projected horizontally to the right, while said pry hook curves downward and to the left;

whereby when said plate is secured via said standard universal skid steer loader mount to said motor vehicle, said spear and pry hook are movable in vertical, horizontal, and rotational directions for pulling up and breaking up horizontally extending structures, pulling over and breaking up vertically extending structures, and extracting vertically extending objects from the ground.

2. An attachment for use in demolition as in claim 1, wherein said spear and pry hook are selected from a group consisting of spears and pry hooks solidly attached to pry hook assemblies and spears and pry hooks removably connected to pry hook assemblies.

3. An attachment for use in demolition as in claim 1, wherein said pry hook has a removable tip.

4. An attachment for use in demolition as in claim 1, further comprising a tubular support connected between said plate and said pry hook assembly.

5. An attachment for use in demolition as in claim 1, further comprising a sleeve, and wherein said spear is removably connected to said pry hook assembly via said sleeve.

6. An attachment as in claim 1, which further comprises at least one side hook affixed to said hook assembly.

7. An attachment according to claim 1 wherein said pry hook is a bucket tooth.

8. An attachment according to claim 1 wherein said spear is a jack hammer bit.

9. A method for demolishing horizontally extending surfaces, said methods comprising the steps of:

a. providing a horizontally extending surface to be demolished;

b. in combination with step a. providing a vehicle with a standard universal skid steer loader mount configured for horizontal, vertical, and rotational movement: a demolition attachment for said vehicle having a plate configured for connection to said mount and a pry hook assembly which comprises a spear and a pry hook, which when viewed in side elevation, is shown projecting in a substantially horizontal direction with said spear being affixed atop said pry hook assembly and also projecting in a substantially horizontally direction beyond said pry hook assembly with said pry hook projecting downwardly and back toward said attachment means;

c. affixing said plate to said mount d. orienting said pry hook assembly above said horizontally extending surface so that said spear projects substantially downward and is oriented for repeatedly pounding said horizontally extending surface until it is cracked;

e. alternatively orienting said pry hook assembly above said horizontally extending surface so that said spear project other than substantially vertically and said pry hook projects generally downward and back toward said plate, so that said pry hook is positioned to snag an edge or created crack in said horizontally extending surfacer and then moves horizontally so as to pry said cracked portions of said horizontally extending surface away from remaining portions thereof; and f. alternatively utilizing said spear to move pieces of said horizontally extending surface.

10. A method of demolishing concrete or asphalt or the like as in claim 9, in which step b. involves affixing said demolishing attachment to a skid steer loader.

11. A method of demolishing concrete as in claim 10, further comprising the steps of providing a plurality of side hooks, positioning said side hooks between said spear and said pry hook, and employing said side hooks with said pry hooks and said spear during demolishing use.

12. A method of demolishing horizontally extending surfaces as in claim 9, in which step a. invokes the providing of said pry hook and said spears selected from the group consisting of: removable spears; permanently affixed spears: removable pry hooks: and permanently affixed pry hooks.

13. The method of claim 9 wherein said pry hook is a bucket tooth.

14. The method of claim 9 wherein said spear is a jack hammer bit.

15. The method of claim 9 further comprising the steps of providing a tubular support and connecting said tubular support between said plate and said pry hook assembly.

16. A method of demolishing comprising:

a. providing a substantially vertically oriented structure and a motor vehicle;

b. in combination with step a. providing tool which comprises: attachment means; and a pry hook assembly which comprises a spear; and pry hook; and said pry hook; a pry hook assembly which comprises a spear; and pry hook; which tool, as viewed in side elevation, presents with said attachment means at one lateral end thereof, said pry hook assembly being affixed thereto and projecting essentially horizontally therefrom, said spear being affixed to a top aspect thereof and projecting essentially horizontally therefrom past the end of said pry hook assembly distal from said attachment means, while said pry hook projects downward and back toward said attachment means.

b. affixing said tool to said vehicle for causing said tool to assume orientation between substantially vertical and substantially horizontal, and to cause said to move, up and down vertically, and/or back and forth horizontally.

b. causing said vehicle to cause said pry hook to be positioned such that it snags a portion of said substantially vertically oriented structure and then moves substantially horizontally so as to cause said substantially oriented structure to be demolishing; and c. using said spear to move resulting demolishing portions of the substantially vertically oriented structure.

17. The method of claim 16 wherein said pry hook is a bucket tooth.

18. The method of claim 16 wherein said spear is a jack hammer bit.

19. The method of claim 16 further comprising the steps of providing a tubular support and connecting said tubular said support between said plate and said pry hook assembly.

20. A method for demolishing concrete or asphalt or the like comprising the steps of:

a. providing a region of concrete or asphalt or the like to be demolished;

b. in combination with step a. providing tool which comprises attachment means; and a pry hook assembly which comprises a spear; and pry hook; and said pry hook; a pry hook assembly which comprises a spear; and pry hook; which tool, as viewed in side elevation, presents with said attachment means at one lateral end thereof, said pry hook assembly being affixed thereto and projecting essentially horizontally therefrom, said spear being affixed to a top aspect thereof and projecting essentially horizontally therefrom past the end of said pry hook assembly distal from said attachment means, while said pry hook projects downward and back toward said attachment means.

c. via said attachment means affixing said tool to a vehicle for causing said tool to assume orientation between substantially vertical and substantially horizontal, and to cause said tool to move, up and down vertically, and/or back and forth horizontally to provide movable pieces of concrete or asphalt or the like, practicing at least one selection from the group consisting of steps d and e wherein step d. is using vehicle to orient said tool vertically above said concrete or asphalt or the like so that said spear projects substantially downward and thereafter cause said spear to repeatedly pound on concrete or asphalt or the like is that is targeted for demolition to the end that the concrete or asphalt or the like is cracked and step e. is using said vehicle to orient said system above concrete or asphalt or the like that is targeted for demolition so that said spear projects other than substantially vertically and said pry hook projects generally downward and back toward said attachment means to cause said pry hook to be positioned such that it snags an edge or created crack in the concrete or asphalt or asphalt or the like targeted for demolition and then moves horizontally so as to pry the cracked concrete or asphalt or the like away from remaining areas of concrete or asphalt or the like; and practicing at least one selection from the consisting of steps f and g wherein f. is the step of utilizing said spear to move pieces of concrete or asphalt or the like and g. is the step of utilizing said pry hook to move pieces of concrete or asphalt or the like.

* * * * *